US009508287B2

(12) United States Patent
Li et al.

(10) Patent No.: US 9,508,287 B2
(45) Date of Patent: Nov. 29, 2016

(54) PIXEL CIRCUIT AND DRIVING METHOD THEREOF, DISPLAY APPARATUS

(71) Applicants: CHENGDU BOE OPTOELECTRONICS TECHNOLOGY CO., LTD., Chengdu, Sichuan (CN); BOE TECHNOLOGY GROUP CO., LTD., Beijing (CN)

(72) Inventors: Tianma Li, Beijing (CN); Hongwei Li, Beijing (CN); Jing Han, Beijing (CN)

(73) Assignees: Chengdu BOE Optoelectronics Technology Co., Ltd., Chengdu (CN); BOE Technology Group Co., Ltd., Beijing (CN)

( * ) Notice: Subject to any disclaimer, the term of this patent is extended or adjusted under 35 U.S.C. 154(b) by 291 days.

(21) Appl. No.: 14/345,480

(22) PCT Filed: May 4, 2013

(86) PCT No.: PCT/CN2013/075161

§ 371 (c)(1),
(2) Date: Mar. 18, 2014

(87) PCT Pub. No.: WO2014/146340

PCT Pub. Date: Sep. 25, 2014

(65) Prior Publication Data

US 2016/0133187 A1 May 12, 2016

(30) Foreign Application Priority Data

Mar. 21, 2013 (CN) ..... 2013 1 0092407

(51) Int. Cl.
*G09G 3/3258* (2016.01)
*G09G 3/32* (2016.01)

(52) U.S. Cl.
CPC ..... *G09G 3/3258* (2013.01); *G09G 3/3233* (2013.01); *G09G 2300/0819* (2013.01);
(Continued)

(58) Field of Classification Search
CPC ..... G09G 3/3258; G09G 2330/021; G09G 2300/0819; G09G 2320/0626; G09G 2320/0233
USPC ..... 345/82–83
See application file for complete search history.

(56) References Cited

U.S. PATENT DOCUMENTS

2005/0285825 A1 12/2005 Eom et al.
2010/0220038 A1* 9/2010 Chung ..... G09G 3/3233 345/76

(Continued)

FOREIGN PATENT DOCUMENTS

CN 1716367 A 1/2006
CN 2008-0001482 A 1/2008

(Continued)

OTHER PUBLICATIONS

Written Opinion of International Searching Authority dated Dec. 12, 2013, in PCT Application No. PCT/CN2013/075161, 4 pages.
English Translation of Written Opinion of International Searching Authority dated Dec. 12, 2013, in PCT Application No. PCT/CN2013/075161, 4 pages.

(Continued)

*Primary Examiner* — Michael Pervan
(74) *Attorney, Agent, or Firm* — Banner & Witcoff, Ltd.

(57) ABSTRACT

A pixel circuit and driving method, display apparatus, the circuit comprises: light-emitting device; driving transistor; first switch-transistor whose source and drain are connected respectively with the gate and drain of the driving transistor; third switch-transistor, whose drain is connected with the light-emitting device, and source is connected with the drain of the driving transistor; storage capacitor, whose first terminal is connected with the gate of the driving transistor; second switch-transistor, whose drain is connected with the second terminal of the storage capacitor, and source is connected with the common connection terminal; fourth switch-transistor, whose source is connected with the second terminal of the storage capacitor; fifth switch-transistor, whose drain is connected with data signal terminal, and source is connected with the drain of the fourth switch-transistor; and first capacitor, whose first terminal is connected with the source of the fifth switch-transistor, and second terminal is connected with the common connection terminal.

13 Claims, 2 Drawing Sheets

(52) U.S. Cl.
CPC ..... *G09G2300/0852* (2013.01); *G09G 2300/0861* (2013.01); *G09G 2320/0233* (2013.01); *G09G 2320/0626* (2013.01); *G09G 2330/021* (2013.01)

(56) References Cited

U.S. PATENT DOCUMENTS

| | | | | |
|---|---|---|---|---|
| 2011/0109299 | A1* | 5/2011 | Chaji | G09G 3/3283 324/76.11 |
| 2012/0026143 | A1* | 2/2012 | Jang | G09G 5/00 345/211 |
| 2012/0248435 | A1 | 10/2012 | Koyama | |

FOREIGN PATENT DOCUMENTS

| | | | |
|---|---|---|---|
| CN | 101740606 | A | 6/2010 |
| CN | 102789761 | A | 11/2012 |
| JP | 2007206273 | A | 8/2007 |

OTHER PUBLICATIONS

English abstract of CN102789761A.
English abstract of CN101740606A.
English abstract of JP2007206273A.
The State Intellectual Property Office of the People's Republic of China ("SIPO") (Chinese Language) Office Action issued on Dec. 17, 2014 by SIPO in Chinese Patent Application No. 201310092407.7; five (5) pages.
English Translation of the State Intellectual Property Office of the People's Republic of China ("SIPO") Office Action issued on Dec. 17, 2014 by SIPO in Chinese Patent Application No. 201310092407.7; three (3) pages.
First Office Action issued by the Chinese Patent Office for Chinese Patent Application No. 201310092407.7 dated Aug. 5, 2014, 7pgs.
English translation of First Office Action issued by the Chinese Patent Office for Chinese Patent Application No. 201310092407.7 dated Aug. 5, 2014, 6pgs.

* cited by examiner

PIXEL CIRCUIT AND DRIVING METHOD THEREOF, DISPLAY APPARATUS

CROSS REFERENCE TO RELATED APPLICATIONS

This application is based on International Application No. PCT/CN2013/075161 filed on May 4, 2013, which claims priority to Chinese National Application No. 201310092407.7 filed on Mar. 21, 2013. The entire contents of each and every foregoing application are incorporated herein by reference.

TECHNICAL FIELD

The present disclosure relates to the field of display manufacture, and particularly to a pixel circuit and a driving method thereof, a display apparatus.

BACKGROUND

As a new display technique, compared with a field effect Thin Film Transistor (TFT) Liquid Crystal Display (LCD), an Active Matrix Organic Light Emitting Diode (AMOLED) display has many advantages in the scope of viewing angle, picture quality, efficiency, and cost, and accordingly has a great potential for development in the field of display manufacture.

The AMOLED is driven by a current generated by a driving TFT in a saturation state and thus can emit lights. The luminance uniformity is always very poor because when inputting a same gray voltage, different critical voltages may generate different driving currents, resulting in that the constancy of the currents becomes very poor.

FIG. 1 illustrates a traditional 2T1C circuit comprising only two TFTs, wherein T1 is a switch transistor and DTFT is the driving transistor for the pixel circuit. The scan line Scan turns on the switch transistor T1, the data voltage Data charges or discharges the storage capacitor C; during the period of light-emitting, the switch transistor T1 is turned off, the driving transistor DTFT remains turned on by the voltage stored in the capacitor, and a turn-on current enables the OLED to emit lights. To implement a stable displaying, the OLED is required to be provided with a stable current. The advantages of a voltage-controlled circuit are that the structure is simple and it is rapid to charge the capacitor, but the disadvantage is that a linear control of the driving current is difficult, because the manufacture process for a Low Temperature Poly-Silicon causes the uniformity of the threshold voltages of the DTFTs very poor, at the same time the threshold voltage may also shift, and the threshold voltages of the different TFTs may be different greatly even though they are manufactured with the same process parameters, which leads to the problems of very poor luminance uniformity and luminance decay for the luminescence for driving the light-emitting circuit.

SUMMARY

Herein a pixel circuit and a driving method thereof, a display apparatus are provided in order to solve the technique problem that the uniformity of the threshold voltages of the driving transistors becomes very poor because of the manufacture processes, which leads to the technique problems of very poor luminance uniformity and luminance decay for the luminescence for driving a light-emitting circuit. A driving current provided by the driving transistor is not affected by the threshold voltage, by compensating the threshold voltage of the driving transistor.

According to an aspect of the present disclosure, there is provided a pixel circuit comprising:

a light-emitting device, the first terminal thereof is connected with a supply voltage terminal;

a driving transistor for driving the light-emitting device, the source of the driving transistor is connected with a common connection terminal;

a first switch transistor, a gate thereof receives a first scan signal, a source thereof is connected with a gate of the driving transistor, and a drain thereof is connected with a drain of the driving transistor;

a third switch transistor, a drain thereof is connected with the other terminal of the light-emitting device, a source thereof is connected with the drain of the driving transistor, and the gate thereof is connected with a control signal;

a storage capacitor, a first terminal thereof is connected with the gate of the driving transistor;

a second switch transistor, a drain thereof is connected with a second terminal of the storage capacitor, and a source thereof is connected with the common connection terminal;

a fourth switch transistor, a gate thereof is connected with the first scan signal, and a source thereof is connected with the second terminal of the storage capacitor;

a fifth switch transistor, a gate thereof is connected with the control signal, a drain thereof is connected with a data signal terminal, and a source thereof is connected with a drain of the fourth switch transistor; and a first capacitor, a first terminal thereof is connected with the source of the fifth switch transistor, and a second terminal thereof is connected with the common connection terminal.

Optionally, the first switch transistor, the second switch transistor, the third switch transistor, the fourth switch transistor, the fifth switch transistor and the driving transistor are all thin film field effect transistors.

Optionally, the first switch transistor, the second switch transistor, the third switch transistor and the driving transistor have the same channel type, and the channel types of the fourth switch transistor and the fifth switch transistor are opposite to those of the first switch transistor, the second switch transistor and the third switch transistor.

Optionally, the first switch transistor, the second switch transistor, the third switch transistor and the driving transistor are N-type thin film field effect transistors, and the fourth switch transistor and the fifth switch transistor are P-type thin film field effect transistors.

Optionally, the common connection terminal is a ground terminal.

Optionally, the light-emitting device is an organic light-emitting diode.

According to another aspect of the present disclosure, there is provided a display apparatus comprising the pixel circuit described above.

According to a further aspect of the present disclosure, there is provided a driving method for the pixel circuit described above, comprising:

during a first stage, the first switch transistor, the second switch transistor and the fifth switch transistor are turned on, the third switch transistor and the fourth switch transistor are turned off, the gate and the drain of the driving transistor are connected, the driving transistor is saturated, and the storage capacitor discharges through the first terminal;

during a second stage, the first switch transistor, the second switch transistor and the third switch transistor are turned off, the fourth switch transistor and the fifth switch transistor are turned on, the storage capacitor and the first capacitor are charged, the voltage at the second terminal of the storage capacitor raise consequently, and the driving transistor is turned on; and during a third stage, the first switch transistor, the second switch transistor and the fifth switch transistor are turned off, the third switch transistor and the fourth switch transistor are turned on, the first capacitor holds the voltage at the first terminal of the storage capacitor while the driving transistor continues being in a turn-on state, a supply voltage signal drives the light-emitting device to emit lights through the driving transistor.

Benefit effects of the present disclosure are that by compensating for the threshold voltage of the driving transistor, the driving current provided by the driving transistor is not affected by the threshold voltage, so as to enhance a constancy of the driving currents, improve the luminance uniformity of the driving circuit and decrease the luminance decay.

Figure 1:
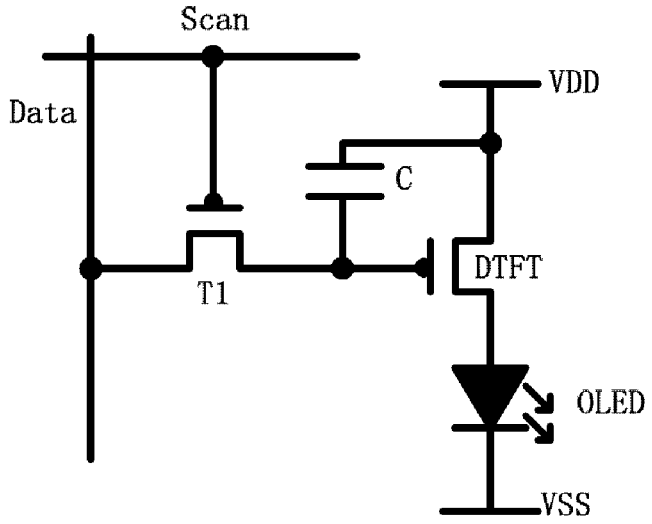
FIG. 1 illustrates a schematic diagram for a 2T1C pixel driving circuit in the prior art.

In the drawings: T1—first switch transistor, T2—second switch transistor, T3—third switch transistor, T4—fourth switch transistor, T5—fifth switch transistor, DTFT—driving transistor, Cst—storage capacitor, C1—first capacitor, VDD—supply voltage terminal, VSS—common connection terminal, Vdata—data signal terminal, Vscan1—first scan signal, EM—control signal.

DETAILED DESCRIPTION

In an embodiment of the present disclosure, there is provided a pixel circuit, which comprises: a light-emitting device, the first terminal of the light-emitting device is connected with a supply voltage terminal; a driving transistor for driving the light-emitting device to emit light, the source of the driving transistor is connected with a common connection terminal; a first switch transistor, the gate thereof receives a first scan signal, the source is connected with the gate of the driving transistor, and the drain is connected with the drain of the driving transistor; a third switch transistor, the drain thereof is connected with the other terminal of the light-emitting device, the source is connected with the drain of the driving transistor, and the gate is connected with a control signal; a storage capacitor, the first terminal is connected with the gate of the driving transistor; a second switch transistor, the drain thereof is connected with the second terminal of the storage capacitor, and the source of the second switch transistor is connected with the common connection terminal; a fourth switch transistor, the gate thereof is connected with the first scan signal, and the source is connected with the second terminal of the storage capacitor; a fifth switch transistor, the gate thereof is connected with the control signal, the drain is connected with a data signal terminal, and the source is connected with the drain of the fourth switch transistor; and a first capacitor, the first terminal thereof is connected with the source of the fifth switch transistor, and the second terminal is connected with the common connection terminal.

The pixel driving circuit according to the embodiments of the present disclosure operates in three stages. During the first stage, the fifth switch transistor is turned on, the third switch transistor and the fourth switch transistor are turned off; the first switch transistor is turned on, so that the gate and the drain of the driving transistor are connected; the second switch transistor is turned on, so that the second terminal of the storage capacitor is connected with the common connection terminal; the driving transistor enters a saturation state, the storage capacitor discharges until the voltage across its two terminals is equal to the threshold voltage of the driving transistor, and the voltage from the data signal terminal is led into the driving circuit. During the second stage, the first switch transistor, the second switch transistor and the third switch transistor are turned off, while the fourth switch transistor and the fifth switch transistor are turned on. The gate and the drain of the driving transistor are connected, the fourth switch transistor and the fifth switch transistor are turned on so that the second terminal of the storage capacitor is connected to the data signal terminal, the level of the second terminal of the storage capacitor is charged to be voltage at the data signal terminal; if it is wanted to remain the voltage of the storage capacitor at the threshold voltage of the driving transistor without changes, the voltage at the first terminal of the storage capacitor boosts to a corresponding value including the threshold voltage of the driving transistor and the voltage at the data signal terminal. During the third stage, the first switch transistor, the second switch transistor and the fifth switch transistor are turned off, the third switch transistor and the fourth switch transistor are turned on; the turning on of the third switch transistor connects a power supply to the drain of the driving transistor for the light-emitting device, and because the supply voltage is much greater than the voltage at the first terminal of the storage capacitor, the driving transistor enters into the saturation state, the light-emitting device starts to emit lights, and at this time, the storage capacitor compensates for the threshold voltage of the driving transistor thereby the current flowing through the driving transistor and the light-emitting device is not affected by the threshold voltage of the driving transistor any more. The present disclosure enhances the constancy of the driving currents of the driving transistors in the pixel circuit, and solves the problems of the non-uniformity of luminance, the luminance decay, etc, in the different pixel unit circuit, caused by the very poor uniformity in the manufacture processes of the driving transistors.

Optionally, a pixel circuit according to an aspect of the present disclosure comprises five switch transistors and a driving transistor. The five switch transistors and the driving transistor are all thin film field effect transistors. The first switch transistor, the second switch transistor, the third switch transistor and the driving transistor have the same channel type, and the fourth switch transistor and the fifth switch transistor have the same channel type. The channel types of the first switch transistor, the second switch transistor, the third switch transistor and the driving transistor are opposite to those of the fourth switch transistor and the fifth switch transistor. The gates of the first, the second and the fourth switch transistors are connected with the first scan signal, as turn-on or turn-off signals, and the gates of the third and fifth switch transistors are connected with the control signal, as turn-on or turn-off signal. The circuit and the circuit driving method are simplified by selecting two switching signals. The selection of the switching signals may be added depending on actual requirements, or different switching signals may be set corresponding to different switch transistors.

Optionally, the third switch transistor is connected between the light-emitting device and the drain of the driving transistor in series, and the light-emitting device is connected between the third switch transistor and the power supply in series. The light-emitting device chooses a top light-emitting manner, the positive electrode of the light-emitting device is connected with the supply voltage terminal, and the negative electrode of the light-emitting device is connected with the drain of the third switch transistor, and of course, correspondingly, the light-emitting device may also choose a bottom light-emitting manner correspondingly, but the top light-emitting manner has a higher aperture ratio than that of the bottom light-emitting manner. The source of the driving transistor is connected with the common connection terminal, the common connection terminal is the ground terminal, and the driving transistor uses a connection way of constant current.

Figure 2:
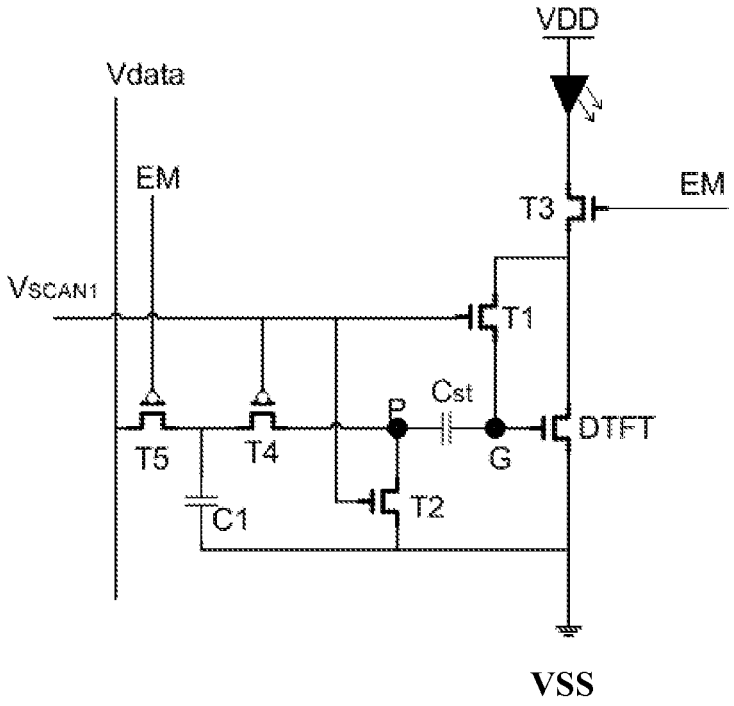
FIG. 2 illustrates a circuit diagram of a pixel circuit according to an exemplary embodiment of the present disclosure.

FIG. 2 is a principle diagram of the pixel circuit according to the exemplary embodiments of the present disclosure. The embodiments of the pixel circuit would be analyzed in details below in connection with FIG. 2.

Referring to FIG. 2, the drain of the first switch transistor T1 is connected with the drain of the driving transistor DTFT, the source of the first switch transistor T1 is connected with the gate of the driving transistor DTFT, and the first switch transistor T1 is used for disconnecting or connecting between the drain and the gate of the driving transistor DTFT; the drain of the second switch transistor T2 is connected with the second terminal (P terminal) of the storage capacitor Cst, the source of the second switch transistor T2 and the source of the driving transistor DTFT are connected with the common ground terminal VSS, and the second switch transistor T2 is used for disconnecting or connecting between the second terminal (P terminal) of the storage capacitor Cst and the common ground terminal VSS; the drain of the third switch transistor T3 is connected with the negative terminal of the light-emitting device, the source of the third switch transistor T3 is connected with the drain of the driving transistor DTFT, and the third switch transistor T3 is used for disconnecting or connecting between the light-emitting device and the drain of the driving transistor DTFT; the fourth switch transistor T4 and the fifth switch transistor T5 are disposed in series between the data signal terminal Vdata and the second terminal (P terminal) of the storage capacitor Cst; the first terminal of the first capacitor C1 is connected with the source of the driving transistor DTFT, the second terminal is connected with a connection point between the drain of the fourth switch transistor T4 and the source of the fifth switch transistor T5; wherein the fourth switch transistor T4 is used for disconnecting or connecting between the second terminal (P terminal) of the storage capacitor Cst and the first capacitor C1; and the fifth switch transistor T5 is used for disconnecting or connecting between the data signal terminal Vdata and the first capacitor C1.

The pixel circuit according to the present embodiment comprises five switch transistors, one driving transistor and two capacitors. Herein, the fourth switch transistor T4 and the fifth switch transistor T5 are P-type transistors, while the first switch transistor T1, the second switch transistor T2, the third switch transistor T3 and the driving transistor are N-type transistors. Level signals inputted from two signal lines of the first scan signal Vscan1 and the control signal EM, are regarded as signals for controlling the turn-on or turn-off of the switch transistors, the common connection terminal VSS is the ground terminal. Optionally, the fourth switch transistor T4 and the fifth switch transistor T5 may be the N-type transistors while the first switch transistor T1, the second switch transistor T2 and the third switch transistor T3 may be the N-type, but the signals for controlling the turn-on or turn-off of the switch transistors need to be adjusted.

As an example, an Organic Light-Emitting Diode (OLED) is connected in series between the power supply and the drain of the driving transistor DTFT as the light-emitting device, and the connecting or disconnecting between the power supply and the drain of the driving transistor DTFT is controlled by the control signal EM received by the gate of the third switch transistor T3. The OLED may utilize the top light-emitting manner, which has the higher aperture ratio than that of the bottom light-emitting manner. The first switch transistor T1 is connected between the gate and the drain of the driving transistor DTFT, and its turn-on or turn-off is controlled by connecting the first scan signal Vscan1 with the gate of the first switch transistor T1. The source of the driving transistor DTFT is connected to the common ground terminal VSS, which is the connection way of constant current, the gate of the driving transistor DTFT is connected with the first terminal (G terminal) of the storage capacitor Cst, the second terminal (P terminal) of the storage capacitor Cst is connected with the common ground terminal VSS through the second switch transistor T2, and the gate of the second switch transistor T2 is connected with the first scan signal Vscan1. The second terminal (P terminal) of the storage capacitor Cst is connected with the second terminal of the first capacitor C1 through the fourth switch transistor T4, and the gate of the fourth switch transistor T4 is connected with the first scan signal Vscan1. The first terminal of the first capacitor C1 and the source of the driving transistor DTFT are together connected to the common ground terminal VSS. The second terminal of the first capacitor C1 is connected to the data signal terminal Vdata through the fifth switch transistor T5, and the control signal EM controls the turn-on or turn-off of the fifth switch transistor T5. The gate of the third switch transistor T3 receives the control signal EM, connects or disconnects the driving transistor DTFT and the OLED, and provides or disconnects the path for the light-emitting of the OLED.

Figure 3:
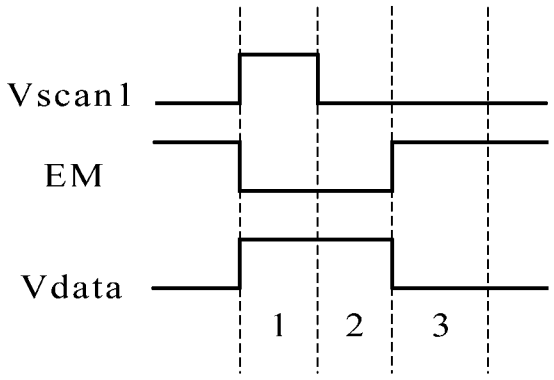
FIG. 3 illustrates a timing chart of the circuit shown in FIG. 2.

The exemplary embodiments of the present disclosure further provide a driving method for driving the pixel circuit described above. Operation states and functions of the respective components in the pixel circuit shown in the FIG. 2 during respective stages would be described in details below in connection with the timing chart shown in FIG. 3.

(1) The first stage is a stage for DATA pre-writing. During the first stage, the level of the first scan signal Vscan 1 is a high level, the level of the control signal EM is a low level, the first switch transistor T1, the second switch transistor T2 and the fifth switch transistor T5 are turned on, the third switch transistor T3 and the fourth switch transistor T4 are turned off. The gate and the drain of the driving transistor DTFT are connected, the second terminal of the storage capacitor Cst and the first terminal of the first capacitor C1 are grounded together, and the second terminal of the first capacitor C1 is connected with the data signal terminal Vdata. At this time, the driving transistor DTFT enters a saturation state, and is a diode in fact. The storage capacitor Cst discharges, and at this time, the voltage difference between the first terminal (G terminal) of the storage capacitor Cst and the second terminal (P terminal) of the storage capacitor Cst is equal to the threshold voltage Vth of the driving transistor DTFT, $Vcst=V_G-V_P=Vth$; the first capacitor C1 is charged, and the voltage across the two terminals of the first capacitor C1 is Vc1=Vdata.

(2) The second stage is a stage for DATA writing. During the second stage, the levels of the first scan signal Vscan1 and the control signal EM are low level, the fourth switch transistor T4 and the fifth switch transistor T5 are turned on, and the first switch transistor T1, the second switch transistor T2 and the third switch transistor T3 are turned off. The second terminal (P terminal) of the storage capacitor Cst and the second terminal of the first capacitor C1 are connected together with the data signal terminal Vdata, the first terminal of the first capacitor C1 is grounded. At this time, the second terminal (P terminal) of the storage capacitor Cst is connected with the first terminal of the first capacitor C1, and meanwhile the second terminal (P terminal) of the storage capacitor Cst is charged to the Vdata. If the voltage across the two terminals of the storage capacitor Cst is to be remained as Vth, the voltage at the first terminal (G terminal) of the storage capacitor Cst jumps to be $V_G=Vth+Vdata$.

(3) A third stage is a stage for light-emitting. During the third stage, the level of the control signal EM is a high level, and the level of the first scan signal Vscan1 is a low level. Therefore, the first switch transistor T1, the second switch transistor T2 and the fifth switch transistor T5 are turned off, and the third switch transistor T3 and the fourth switch transistor T4 are turned on. The second terminal (P terminal) of the storage capacitor Cst is connected with the second terminal of the first capacitor C1, the first terminal of the first capacitor C1 is grounded, and the drain of the driving transistor DTFT, the OLED and the supply voltage terminal VDD are connected in series, and the driving transistor DTFT is turned on. The first capacitor C1 holds the voltage at the first terminal (G terminal) of the storage capacitor Cst as $V_G=Vth+Vdata$, while the driving transistor continues being in a turn-on state, the supply voltage signal drives the light-emitting device to emit lights through the driving transistor. Because the supply voltage VDD is much greater than the voltage $V_G$ at the gate of the driving transistor (the G terminal of the Cst), the driving transistor DTFT enters the saturation state, and at this time the current I flowing through the driving transistor DTFT and the OLED is:

$$I=K(V_{GS}-Vth)^2=K(Vdata+Vth-Vth)^2=K(Vdata)^2.$$

As analyzed in step (3), the current I flowing through the driving transistor DTFT and the OLED at this time is not affected by the threshold voltage Vth of the driving transistor DTFT, such that the phenomenon of the non-uniformity of the threshold voltages Vths of the driving transistors DTFTs caused by the manufacture process may be improved, the uniformity of the current may also be improved, and the uniformity of the luminance of the OLED is obtained.

The exemplary embodiments of the present disclosure further provide a display apparatus comprising the pixel circuit described above, each OLED light-emitting unit in the display apparatus implements the constancy of the currents in the OLED circuit by compensating for the threshold voltages of the OLED driving transistors DTFTs, and solves the problems of the non-uniformity of luminance, the luminance decay, etc, of the panel of the display apparatus.

Exemplary embodiments of the present invention are described above, and it should be noted that for those ordinary skilled in the technical field, a number of improvements and modifications can be made without departing from the principle of the invention, such modifications and retouch should also be considered within the protection scope of the present invention.

What is claimed is:

1. A pixel circuit comprising:

a light-emitting device, one terminal thereof is connected with a supply voltage terminal;

a driving transistor for driving the light-emitting device, whose source is connected with a common connection terminal;

a first switch transistor, whose gate receives a first scan signal, source is connected with a gate of the driving transistor, and drain is directly connected with a drain of the driving transistor;

a third switch transistor, whose drain is connected with the other terminal of the light-emitting device, source is connected with the drain of the driving transistor, and gate is connected with a control signal;

a storage capacitor, whose first terminal is connected with the gate of the driving transistor; a second switch transistor, whose drain is connected with a second terminal of the storage capacitor, and source is connected with the common connection terminal;

a fourth switch transistor, whose gate is connected with the first scan signal, and source is directly connected with the second terminal of the storage capacitor;

a fifth switch transistor, whose gate is connected with the control signal, drain is directly connected with a data signal terminal, and source is connected with a drain of the fourth switch transistor; and a first capacitor, whose first terminal is connected with the source of the fifth switch transistor, and second terminal is connected with the common connection terminal.

2. The pixel circuit of claim 1, wherein the first switch transistor, the second switch transistor, the third switch transistor, the fourth switch transistor, the fifth switch transistor and the driving transistor are all thin film field effect transistors.

3. The pixel circuit of claim 2, wherein the first switch transistor, the second switch transistor, the third switch transistor and the driving transistor have the same channel type, and the channel types of the fourth switch transistor and the fifth switch transistor are opposite to those of the first switch transistor, the second switch transistor, the third switch transistor and the driving transistor.

4. The pixel circuit of claim 3, wherein the first switch transistor, the second switch transistor, the third switch transistor and the driving transistor are N-type thin film field effect transistors, and the fourth switch transistor and the fifth switch transistor are P-type thin film field effect transistors.

5. The pixel circuit of claim 1, wherein the common connection terminal is a ground terminal.

6. The pixel circuit of claim 1, wherein the light-emitting device is an organic light-emitting diode.

7. A display apparatus comprising the pixel circuit of claim 1.

8. A driving method for the pixel circuit of claim 1, comprising:

during a first stage, the first switch transistor, the second switch transistor and the fifth switch transistor are turned on, the third switch transistor and the fourth switch transistor are turned off, the gate and the drain of the driving transistor are connected, the driving transistor is saturated, and the storage capacitor discharges through its first terminal;

during a second stage, the first switch transistor, the second switch transistor and the third switch transistor are turned off, the fourth switch transistor and the fifth switch transistor are turned on, the storage capacitor and the first capacitor are charged, the voltage at the second terminal of the storage capacitor raises consequently, and the driving transistor is turned on; and during a third stage, the first switch transistor, the second switch transistor and the fifth switch transistor are turned off, the third switch transistor and the fourth switch transistor are turned on, the first capacitor holds the voltage at the first terminal of the storage capacitor while the driving transistor continues being in a turn-on state, a supply voltage signal drives the light-emitting device to emit lights through the driving transistor.

9. The display apparatus of claim 7, wherein the first switch transistor, the second switch transistor, the third switch transistor, the fourth switch transistor, the fifth switch transistor and the driving transistor are all thin film field effect transistors.

10. The display apparatus of claim 9, wherein the first switch transistor, the second switch transistor, the third switch transistor and the driving transistor have the same channel type, and the channel types of the fourth switch transistor and the fifth switch transistor are opposite to those of the first switch transistor, the second switch transistor, the third switch transistor and the driving transistor.

11. The display apparatus of claim 10, wherein the first switch transistor, the second switch transistor, the third switch transistor and the driving transistor are N-type thin film field effect transistors, and the fourth switch transistor and the fifth switch transistor are P-type thin film field effect transistors.

12. The display apparatus of claim 7, wherein the common connection terminal is a ground terminal.

13. The display apparatus of claim 7, wherein the light-emitting device is an organic light-emitting diode.

* * * * *